United States Patent [19]

Byard

[11] 4,067,521

[45] Jan. 10, 1978

[54] ATTACHING CLIP

[75] Inventor: L. George Byard, Bartonville, Ill.

[73] Assignee: Keystone Consolidated Industries, Inc., Peoria, Ill.

[21] Appl. No.: 675,333

[22] Filed: Apr. 9, 1976

[51] Int. Cl.[2] ..... A44B 13/00; B65D 85/04

[52] U.S. Cl. ..... 245/10; 24/230.5 W; 245/3; 206/53; 24/73 C; 24/230.5 AD

[58] Field of Search .....24/73 C, 73 HR, 24/73 HH, 73 TH, 73 HL, 230.5 T, 230.5 W, 39; 245/3, 10, 7; 206/53, 55; 256/45

[56] References Cited

U.S. PATENT DOCUMENTS

| | | | |
|---|---|---|---|
| 573,370 | 12/1896 | Swinscoe | 245/7 |
| 1,051,397 | 1/1913 | Frederick | 245/3 |
| 1,074,904 | 10/1913 | Smith | 245/10 |
| 1,169,492 | 1/1916 | Clark | 206/389 |
| 2,007,862 | 7/1935 | Hurxthal | 245/10 |
| 2,031,889 | 2/1936 | Himberger | 245/3 |
| 2,059,188 | 11/1936 | Alford | 24/73 C |
| 2,858,894 | 11/1958 | Akeyson | 245/10 |
| 3,172,532 | 3/1965 | Wright | 206/389 |

FOREIGN PATENT DOCUMENTS

| | | | |
|---|---|---|---|
| 28,562 | 8/1930 | Australia | 245/7 |
| 146,461 | 4/1931 | Switzerland | 245/7 |

*Primary Examiner*—Bernard A. Gelak

*Attorney, Agent, or Firm*—Allegretti, Newitt, Witcoff & McAndrews

[57] ABSTRACT

An improved attaching clip is disclosed for use with a roll of steel wire mesh reinforcing that is designed to be utilized in concrete negative buoyancy coatings. The clip is secured to the leading or free end of the roll and may be used to connect the leading end of the roll to the remaining portion of the roll so as to prevent the unrolling of the roll during storage and handling. The clip may also be utilized to connect the leading end of the roll to the trailing end of another similar roll of steel wire mesh reinforcing so that the two rolls form a continuous strip of steel wire mesh reinforcing so as to facilitate the installation of the reinforcing.

6 Claims, 6 Drawing Figures

ATTACHING CLIP

BACKGROUND AND SUMMARY OF THE INVENTION

The present invention relates to an improved attaching clip, and more particularly, to an improved attaching clip for use with rolls of steel wire mesh reinforcing which comprise a portion of concrete negative buoyancy coatings applied to oil and gas transmission pipe lines.

In the past, rolls of steel wire mesh reinforcing have been manufactured especially to serve as reinforcing for concrete negative buoyancy coatings applied to oil and gas transmission pipe lines. Even though such concrete coatings are applied over pipe, which provides a structural base, a reinforcing with a large bonding area is needed to make the coatings resistant to the handling shocks and bending as the pipes conform to the contours of the bottoms of bays and rivers when they are laid in place. While concrete coatings can be installed by positioning the reinforcing spirally about a pipe and then by applying the concrete pneumatically, coating machines have been utilized for a number of years to continuously apply the steel mesh reinforcing to the pipes at the same time as the concrete is applied. The use of such coating machines has the advantage of applying the negative buoyancy coatings to pipes at a relatively high rate while assuring that the wire mesh reinforcing is properly positioned in the coating for maximum reinforcement.

Steel wire mesh reinforcing has generally been supplied for use in concrete negative buoyancy coatings in 900 foot rolls. The coating machines are conventionally operated at a rate such that the mesh reinforcing in such a 900 foot roll is generally installed in about 1 to 2 minutes. Consequently, operators of coating machines have in the past attempted to find means by which the leading edge of a new roll of wire mesh reinforcing could be readily connected to the trailing end of a roll which is then being applied to the pipes so as to minimize coating machine "down time."

In the past, a wire clip has been used by operators of coating machines to interconnect the leading edge of a new roll with the trailing edge of an old roll of steel wire mesh reinforcing. This prior clip included two pairs of spaced cross wires that are secured together at the points at which the wires overlap and that are arranged so that the prior clip generally had a "tic-tac-toe-like" appearance. The opposite ends of one of the pairs of wires of the clip were formed as hooks, and these hooks were used by the operator of the coating machine to interconnect the mesh defining wires adjacent to the trailing end of the old roll with the leading end of the new roll. While this prior clip generally performed its intended function adequately, it had to be basically "hand made" and was consequently relatively expensive to properly It is a primary object of my present invention to provide an improved attaching clip for connecting the leading or free end of a new roll of steel wire mesh reinforcing with the trailing end of a similar roll of reinforcing while the rolls are being used with a coating machine for applying concrete negative buoyancy coating to pipes. Another object of my present invention is to provide an improved attaching clip of the type described which may be secured to the leading or free end of a roll of steel wire mesh reinforcing by the manufacturer of the reinforcing so as to be used initially to connect the leading end to the remaining portion of the roll during storage and handling and which then may be used to attach the leading end of the roll to the trailing end of a similar roll of mesh reinforcing by the operator of a coating machine when the rolls are being applied as a part of the concrete negative buoyancy coating of a pipe.

More specifically, the improved attaching clip of my present invention includes an integral wire body having a transverse portion and a pair of integral arm portions. The one ends of the arm portions are connected with the ends of the transverse portion while the other ends of the arm portions are bent or formed as an integral crook or hook-like portion. The distal end portion of these crook portions project back toward the transverse portion and are disposed at an acute angle with the longitudinal axes of the arm portions. The transverse portion is adapted to be secured to the leading end of a roll of steel wire mesh reinforcing and is offset or slightly spaced from the plane defined by the two arm portions. When the improved attaching clip is properly secured to the leading end of the roll, the longitudinal axis of the transverse portion is disposed transversely to the longitudinal axis of the roll, i.e. to the axis parallel to the path of travel of the roll. The distal end portions of the improved clip are adapted so that they may be readily slipped over the mesh defining wires of either the trailing end of a roll of wire mesh reinforcing or another portion of the roll to which the clip is secured. The crook portions of the improved clip are constructed so that they function as a spring lock and thus assist in retaining the mesh defining wires within the crook portion once the end portions have been slipped over these wires.

These and other objects and advantages of my present invention will become apparent to those having skill in this art from the following description of the preferred embodiment of my invention, as shown in the accompanying drawings.

Figure 1:
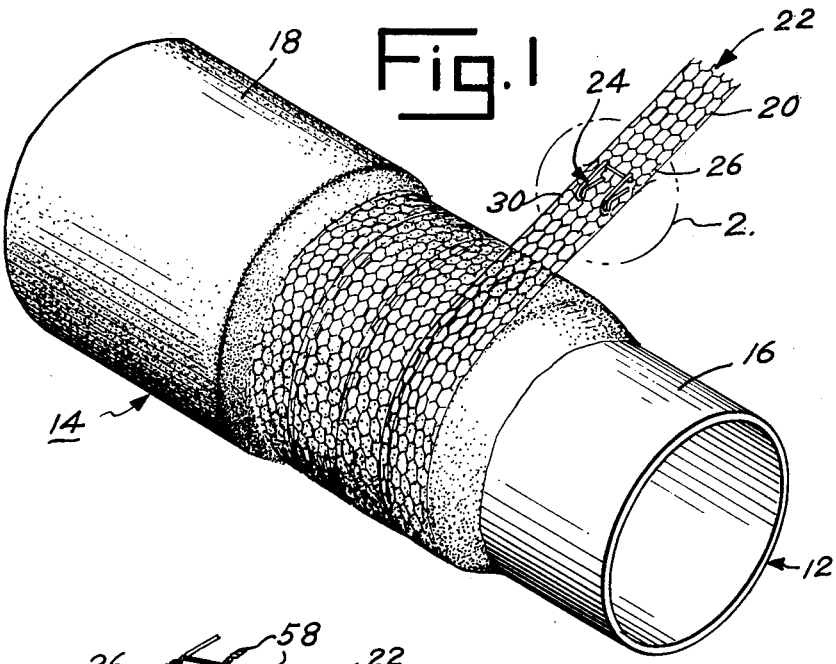
FIG. 1 is a perspective view showing a negative buoyancy coating, including steel wire mesh reinforcing, being applied to a pipe, and also showing an improved clip of my present invention being utilized to interconnect the leading and trailing ends of two rolls of the mesh reinforcing.

Throughout the various figures of the drawings, the same reference numerals will be used to designate the same parts or components. Moreover, when the terms "rearward," "forward," "side," "upper" and "lower" are used herein, it is to be understood that these terms have reference to the structure shown in the drawings, as it would appear to a person viewing the drawings.

DESCRIPTION OF THE PREFERRED EMBODIMENT

Referring now to FIG. 1, a pipe 12 is shown having a concrete negative buoyancy coating 14 being applied to its outer surface 16. The coating 14 includes concrete 18 and a continuous strip 20 of relatively narrow width steel wire mesh reinforcing 22 that is spirally wound about the outer surface 16 of the pipe. Even though the concrete 18 applied over the outer surface 16 of the pipe 12, which in itself provides a structural base for the coating 14, the reinforcing 22 is needed to make the coating 14 resistant to handling shocks and the bending of pipe lines when they conform to the contours of the bottom of bays and rivers as they are laid in place.

The coating 14 may be applied to the pipe 12 either manually or by relatively an automatic coating machine, not shown. Application of the coating 14 by means of a coating machine is preferred, however, in the industry since the machines can be adjusted so that the reinforcing 22 may be applied in exactly the proper position in the coating 14 for maximum reinforcement and in addition, such coating machines obviously can apply the coating 14 at a much more rapid rate.

As noted above, one of the problems faced by those working in this art was how to minimize the "down time" of the coating machine when a roll of steel wire mesh reinforcing had been completely applied. This problem is significant since even though the mesh reinforcing is conventionally supplied in 900 foot rolls, a roll will generally be applied by a coating machine in a minute or two.

Figure 6:
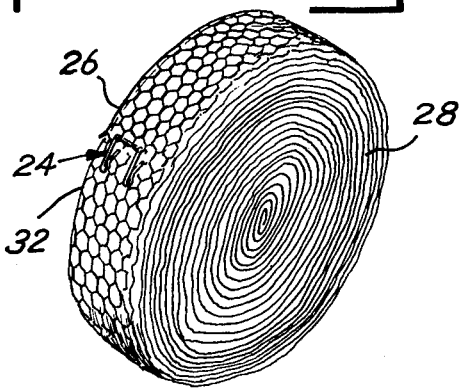
FIG. 6 is a perspective view of a roll of steel wire mesh reinforcing shown with a clip of my present invention being utilized to secure the leading end of the roll to the remaining portion of the roll so as to prevent the unrolling of the roll during storage or handling.

The improved attaching clip of my present invention, shown generally at 24, affords an admirable solution to this problem by providing a facile means for attaching the leading end 26 of a new roll 28 of steel wire mesh reinforcing 22 to the trailing end 30 of another roll of reinforcing 22. As shown in FIG. 6, the clip 24 has the additional advantage that it may be utilized to connect the leading end 26 of the roll 28 to the remaining portion 32 of the roll 28 during pre-application handling and storage.

Figure 4:
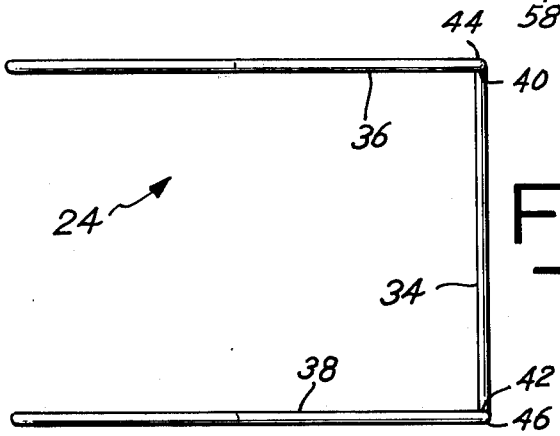
FIG. 4 is a top plan view of the improved clip of my present invention.
Figure 5:
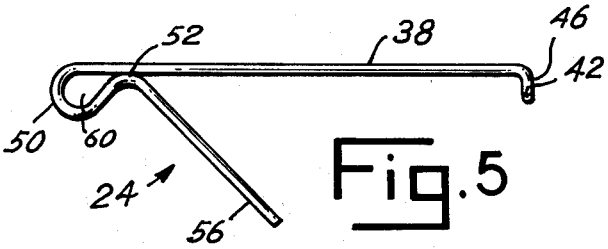
FIG. 5 is a side elevational view of the improved clip of my present invention.

Referring now to FIGS. 4 and 5, the improved attaching clip 24 has an integral body formed from a single continuous piece of galvanized wire. The clip 24 includes a transverse portion 34 and two substantially identical arm portions 36 and 38. The longitudinal axis of the transverse portion 34 is generally perpendicular to the longitudinal axis of the arm portions 36 and 38. The ends 40 and 42 of the transverse portion 34 are disposed adjacent to the one ends 44 and 46 of the two arm portions 36 and 38, respectively, and the ends 40–44 and 42–46 are bent so that the transverse portion 34 is disposed below a first plane defined by the arm portions 36 and 38.

Two substantially identical crook or hook-like portions 48 and 50 are formed in the other ends of the arm portions 36 and 38, respectively, i.e. the ends of the arm portions spaced from the transverse portion 34. The crook portions 48 and 50 are bent so that portion 52, as shown in FIG. 5, contacts the arm portions 36 and 38 adjacent the other ends of the arm portions. The crook portions 48 and 50 terminate in relatively straight distal end portions 54 and 56 which project rearwardly or back towards the transverse portion 34 and which form an angle, preferably 45°, with the longitudinal axis of their respective, adjacent arm portion.

The crook portions 48 and 50 are formed so that they function as a spring lock or snap spring and thus assist in retaining the wires 58 which define the mesh of the reinforcing 22 and which are disposed within the openings 60 encircled by the crook portions 48 and 50. As shown best in FIG. 5, the transverse portion 34 and the end portion 54 and 56 project in the same direction from the first plane which is defined by the arm portion 36 and 38. The end portions 54 and 56 are arranged so that they facilitate their entry into the mesh of the reinforcing 22.

The arm portion 36, the crook portion 48 and the end portion 54, define a second plane which is parallel to a third plane defined by the arm portion 38, the crook portion 50 and the end portion 56. The second and third planes are perpendicular to the longitudinal axis of the transverse portion 34.

Figure 2:
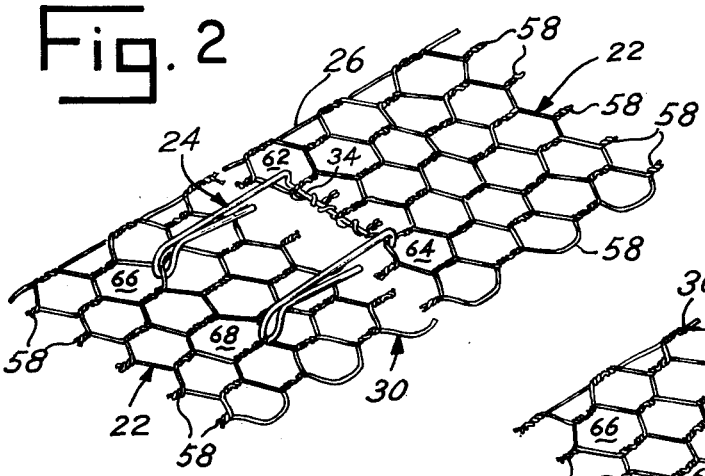
FIG. 2 is an enlarged view, taken along the line 2 in FIG. 1.
Figure 3:
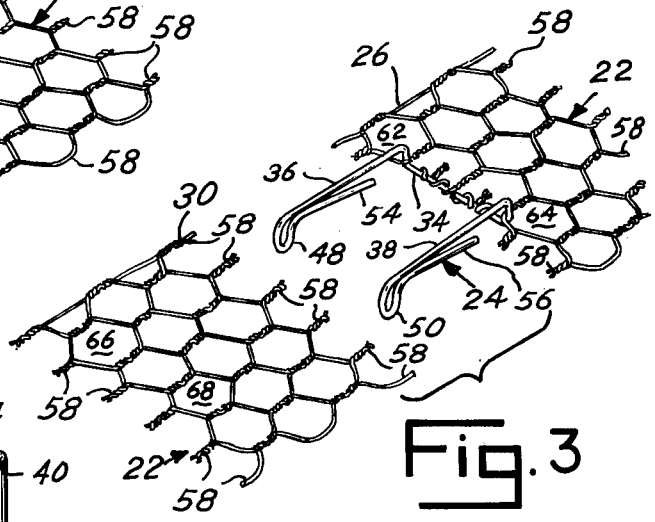
FIG. 3 is a view similar to FIG. 2 except that the leading and trailing ends of the rolls are shown spaced apart.

As best shown in FIGS. 2 and 3, the clip 24 is attached to the leading end 26 of a roll of steel wire mesh reinforcing by wrapping two of the pairs of mesh defining wires 58 about the transverse portion 34 so that the ends 40 and 42 of the transverse portion 34 are adjustable to the side edges of the strip 20 of the reinforcing 22 and so that the longitudinal axis of the transverse portion 34 is substantially perpendicular to the longitudinal axis, i.e. the path of travel, of the strip 20. In this regard, the arm portions 36 and 38 are introduced upwardly through the two adjacent mesh openings 62 and 64 prior to these wires 58 being wrapped around the transverse portion 34. Due to the offset between the transverse portion 34 and the first plane, as defined by the arm portions, 36 and 38, the arm portions are thus disposed slightly above the plane of the reinforcing 22 when the first plane, as defined by the arm portions, is substantially parallel to the plane of the reinforcing. The longitudinal dimension of the transverse portion 34 is selected so that it is slightly longer than the distance between at least two adjacent mesh in the roll with which the clip 24 will be used. This permits the clip 24, when secured to the leading end 26, to be free to pivot, through a limited arc, about an axis coaxial with the longitudinal axis of the transverse portion 34 and with respect to the leading end 26. This freedom to pivot facilitates the engagement of the crook portions 48 and 50 with other mesh reinforcing. Such an engagement is initiated by inserting the end portions 54 and 56 into the mesh, such as mesh 66 and 68 in the trailing end 30, as shown in FIG. 2. The wires 58 which form the mesh 66 and 68 are forced past the points 52 so that these wires are disposed within the crook portions 48 and 50. The resilience of the wire forming crook portions 48 and 50 impede the withdrawal of these wires 58 from within the crook portions such that the crook portions, in effect, functions as a spring lock to hold these wires 58 therewithin.

In normal practice, the leading end 26 and the trailing end 30 of the rolls to be connected by the clip 24 are overlapped slightly, but in FIG. 2, this overlap is not shown for clarity of illustration. When the ends 26 and 30 are overlapped, the clip 24 is used in the same manner as described above.

As noted above, the clip 24 may also be used to connect the leading or free end 26 of the roll 28 to the remaining portion of the roll as shown in FIG. 6. The interconnection between the clip 24 and the remaining portion of the roll 28 is accomplished in the same manner as described above in connection with the attachment of the leading and trailing ends 26 and 30, respectively, and is facilitated by the ability of the clip 24 to pivot upwardly away from the plane of the mesh reinforcing 22.

A clip, such as described above, has been constructed and tested, and this testing has demonstrated that the clip performs its intended function admirably and with facility. In one such clip, galvanized, twelve gauge steel wire is used to form the clip. The portion of the clip corresponding to the transverse portion 34 has a longitudinal dimension, end-to-end, of 3 inches, while the longitudinal length of the arm portions 36 and 38 is four inches. The distal end portions 54 and 56 extend approximately one and seven eighths inches from the point of contact 52 to their ends. The end portions 54 and 56 define an angle of 45° with the arm portions 36 and 38. The openings 60 defined by the crook portions 48 and 50 have a "diameter" of approximately ¼ of an inch, and the transverse portion 34 is offset from the first plane, as defined by the arm portions 36 and 38, approximately one eighth of an inch.

In conclusion, it should be apparent to those having skill in this art, that the clip 24 of my present invention affords significantly improved means for interconnecting leading and trailing ends 26 and 30 of rolls 28 of steel wire mesh reinforcing. In addition, the clip 24 may also be used to connect the leading end 26 of the roll 28 of wire mesh reinforcing to the remaining portions of the roll during shipment and storage. The clip 24 can be easily and quickly secured to the leading edge 26 of the roll 28 by the manufacturer of the roll and and can be inexpensively made from a single piece of wire.

It should also be obvious to those having skill in this art that various modifications could be made in the clip 24. For example, the angle between the end portions 48 and 50 and the arm portions 36 and 38 could be varied. Thus, since the invention disclosed herein may be embodied in other specific forms without departing from the spirit or the central characteristics thereof, the preferred embodiment described herein is therefore to be considered in all respects as illustrative and not restrictive, the scope of the invention being indicated by the appended claims, rather than by the foregoing description, and all changes which come within the meaning and range of equivalency of the claims therefore intended to be embraced therein.

I claim:

1. An improved attaching clip for initially connecting the leading end of a first roll of steel wire mesh reinforcing to the remaining portion of the first roll so as to prevent the unrolling of the first roll during storage, handling and shipment to a place where the first roll is to be applied about pipes to form negative buoyancy coatings about the pipes and then for subsequently connecting the leading end of the first roll to the trailing end of a second, similar roll of steel wire mesh reinforcing so that the first and second rolls form a continuous strip of steel wire mesh reinforcing as they are applied about the pipes, the leading end of the first roll including a plurality of evenly spaced pairs of mesh defining wires, the improved attaching clip comprising: a body formed from wire and having a transverse portion whose longitudinal axis extends transversely to the longitudinal axis of the first roll of steel wire mesh reinforcing so that one end of the transverse portion is disposed adjacent to one side edge of the first roll and so that the other end of the transverse portion is disposed adjacent to the other side edge of the first roll and whose length is greater than the transverse distance between two adjacent pairs of mesh defining wires; means for securing the transverse portion to the first roll, adjacent to the leading end of the first roll, by wrapping two adjacent pairs of mesh defining wires about the transverse portion; the body also having first and second arm portions, each of these arm portions including a first end and a second end, with the first end of the first arm portion being connected with the one end of the transverse portion so that the longitudinal axis of the first arm portion is substantially perpendicular to the longitudinal axis of the transverse portion, with the first end of the second arm portion being connected with the other end of the transverse portion so that the longitudinal axis of the second arm portion is substantially perpendicular to the longitudinal axis of the transverse portion, and with the second ends of the first and second arm portions projecting forwardly beyond the leading end of the first roll; first and second curved crook portions which are connected at their one ends with the second ends of the first and second arm portions, respectively, and which generally define curved loops such that the other ends of the first and second crook portions are bent rearwardly toward the transverse portion and are disposed generally adjacent to the first and second arm portions, respectively, intermediate their first and second ends; and first and second distal end portions that are connected at their one ends to the other ends with the first and second crook portions, respectively, and that extend rearwardly toward the transverse portion, with each of the first and second distal end portions being disposed at an angle with the longitudinal axis of their respective adjacent arm portions and with the other, free ends of the first and second distal end portions being spaced from the first and second arm portions, respectively, and being adapted to engage the mesh defining wires of a roll of steel wire mesh reinforcing.

2. The improved attaching clip described in claim 1 wherein the first arm portion and the first distal end portion define a first plane that is parallel to a second plane defined by the second arm portion and the second distal end portion and that is perpendicular to the longitudinal axis of the transverse portion.

3. The improved attaching clip described in claim 2 wherein the longitudinal axes of the first and second arm portions are substantially parallel; and wherein the first and second arm portions are disposed in a third plane that is offset from and spaced from a fourth, parallel plane which includes the transverse portion.

4. The improved attaching clip described in claim 2 wherein the transverse portion and the first and second distal end portions are disposed on the same side of the third plane.

5. The improved attaching clip described in claim 4 wherein each of the first and second distal end portions form an angle of approximately 45° with the longitudinal axis of the first and second arm portions, respectively; and wherein the body is formed from a single, continuous piece of wire.

6. The improved attaching clip described in claim 1 wherein the body if formed from a single continuous piece of wire; wherein the longitudinal axes of the first and second arm portions are substantially parallel; and wherein the first and second arm portions are disposed in a first plane that is offset from and spaced from a second, parallel plane which includes the transverse portion; and wherein the transverse portion and the first and second distal end portions are disposed on the same side of the first plane.

* * * * *